US012127661B2

(12) United States Patent
Pagneux et al.

(10) Patent No.: US 12,127,661 B2
(45) Date of Patent: Oct. 29, 2024

(54) COSMETIC PRODUCT DISPENSER POT WITH A STACKED BASE, REFILL AND COVER

(71) Applicant: ALBEA SERVICES, Gennevilliers (FR)

(72) Inventors: Alain Pagneux, Gennevilliers (FR); Daniel Carraro, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 17/558,354

(22) Filed: Dec. 21, 2021

(65) Prior Publication Data

US 2023/0103213 A1 Mar. 30, 2023

(30) Foreign Application Priority Data

Sep. 24, 2021 (FR) ..... 2110079

(51) Int. Cl.
*A45D 40/00* (2006.01)
*B65D 77/04* (2006.01)

(52) U.S. Cl.
CPC ..... *A45D 40/0075* (2013.01); *B65D 77/0486* (2013.01); *A45D 2200/05* (2013.01)

(58) Field of Classification Search
CPC ..... B65D 77/0486; A45D 40/0068; A45D 34/00; A45D 2034/005; A45D 2200/05
See application file for complete search history.

(56) References Cited

U.S. PATENT DOCUMENTS

| | | | | |
|---|---|---|---|---|
| 3,067,896 | A | 12/1962 | Berg | |
| 4,083,482 | A * | 4/1978 | Strenczewilk | B65D 71/0003 D7/706 |
| 5,938,016 | A | 8/1999 | Erdtmann | |
| 8,870,011 | B2 | 10/2014 | Hammer | |
| 2020/0037729 | A1 | 2/2020 | Reid | |
| 2020/0275759 | A1 * | 9/2020 | Chevalier | A45D 40/0068 |

(Continued)

FOREIGN PATENT DOCUMENTS

| | | | |
|---|---|---|---|
| CN | 203897605 | U | 10/2014 |
| DE | 202019100062 | U1 | 1/2019 |

(Continued)

OTHER PUBLICATIONS

EP21213586.7, "Communication Pursuant to Article 94(3) EPC", Mar. 21, 2023, 12 pages.

(Continued)

*Primary Examiner* — Anthony D Stashick
*Assistant Examiner* — L Kmet
(74) *Attorney, Agent, or Firm* — Kilpatrick Townsend & Stockton LLP

(57) ABSTRACT

A pot for dispensing cosmetic product includes a base having a hollow body surmounted by a neck, the base defining a housing adapted to receive the cosmetic product, at least one refill of cosmetic product mounted on the base, and a cover closing the pot and adapted to be attached on the base or the refill. The base, the refill and the cover are successively stacked. The refill has a tank for storing the cosmetic product, the inner volume of which is at least identical to the inner volume of the housing of the base, the tank being inserted into the housing of the base by descending below the level of the neck of the base.

10 Claims, 4 Drawing Sheets

(56) References Cited

U.S. PATENT DOCUMENTS

| | | | |
|---|---|---|---|
| 2021/0093069 | A1 | 4/2021 | Jesberg |
| 2021/0139198 | A1 | 5/2021 | Canamasas |

FOREIGN PATENT DOCUMENTS

| | | | | |
|---|---|---|---|---|
| DE | 202019105018 | U1 | | 1/2021 |
| JP | 3152177 | U | * | 7/2009 |
| JP | 6235970 | | | 11/2017 |
| JP | 2019189327 | | | 10/2019 |
| JP | 6852890 | | | 3/2021 |
| KR | 101211964 | B1 | | 6/2010 |
| KR | 101205002 | B1 | | 11/2012 |
| KR | 101673443 | | | 10/2014 |
| KR | 1020150061615 | | | 6/2015 |
| KR | 102216642 | | | 7/2018 |
| KR | 102107180 | | | 2/2020 |
| KR | 102158608 | B1 | | 2/2020 |
| KR | 102201573 | B1 | | 5/2020 |
| KR | 20210006719 | A | | 1/2021 |
| KR | 1020210026794 | | | 3/2021 |
| KR | 1020210030051 | | | 3/2021 |
| KR | 200468321 | U | | 5/2021 |
| KR | 102221054 | | | 6/2021 |
| WO | WO-2019058087 | A1 | | 6/2018 |
| WO | WO-2018115685 | A1 | | 3/2019 |

OTHER PUBLICATIONS

EP21213586.7, "European Search Report", Jun. 15, 2022, 10 pages.
Fr2110079, "French Search Report", Jun. 13, 2022, 10 pages.

* cited by examiner

[Fig.1]
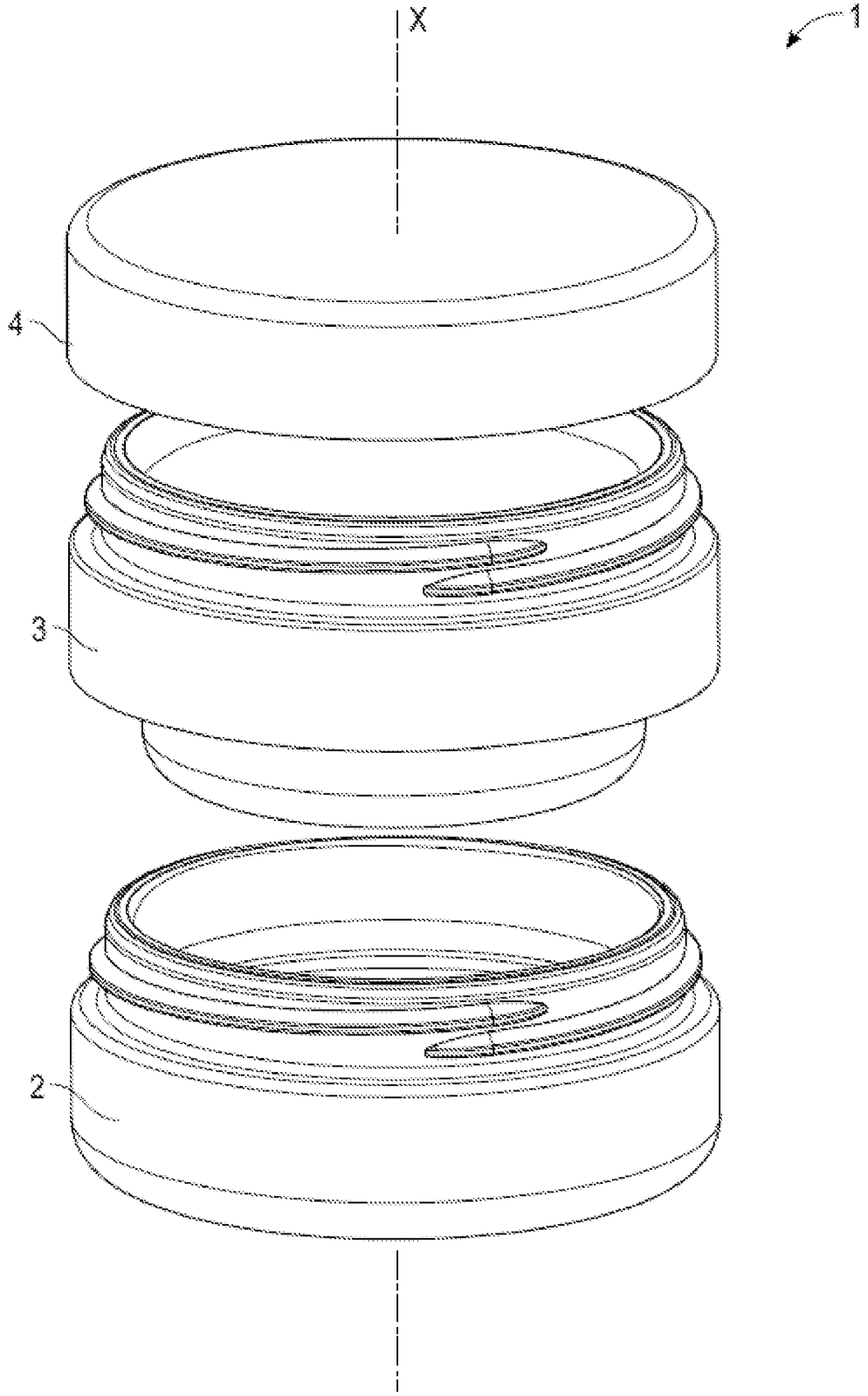

[Fig.2]
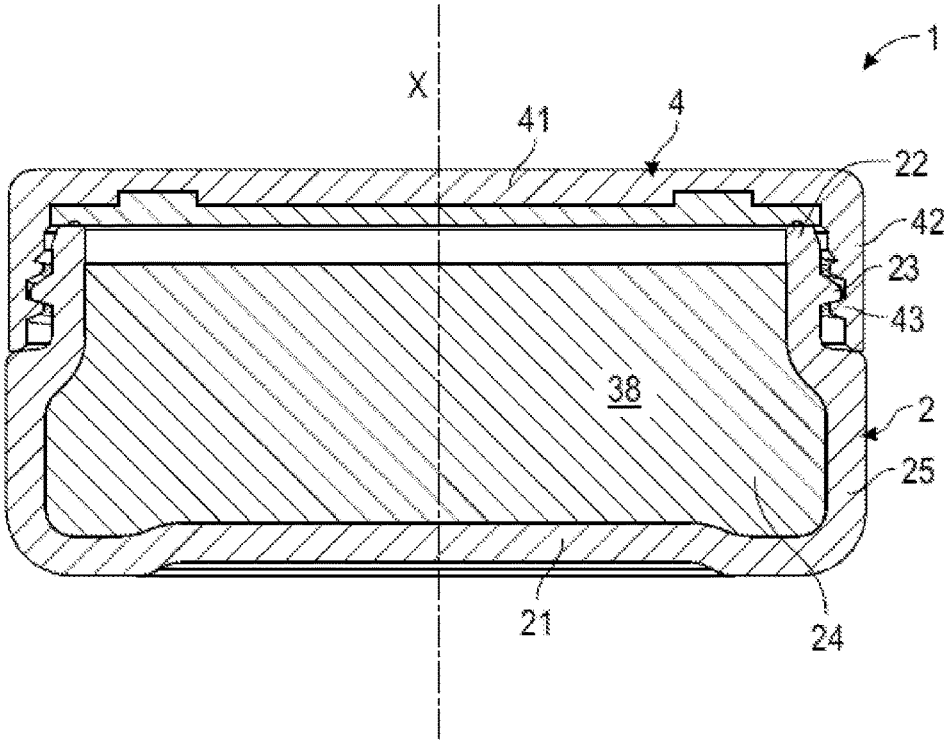
[Fig.3]
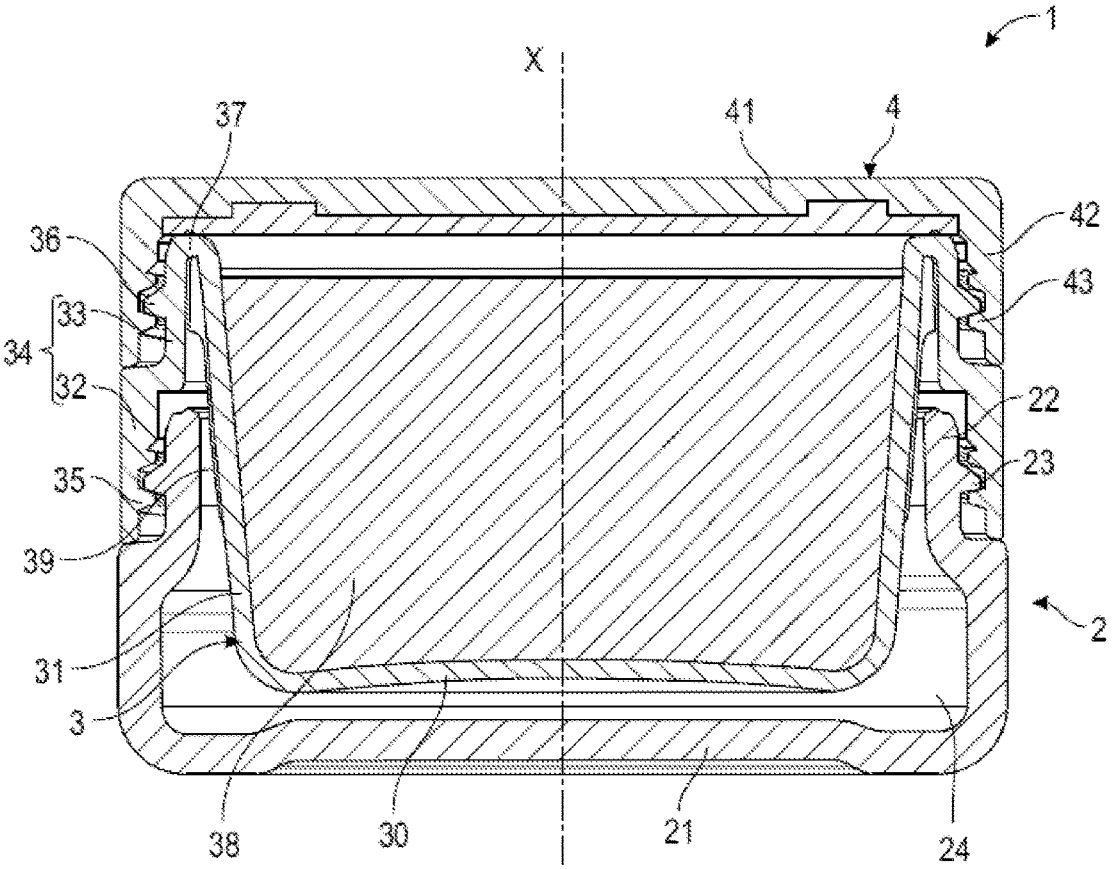

[Fig.4]
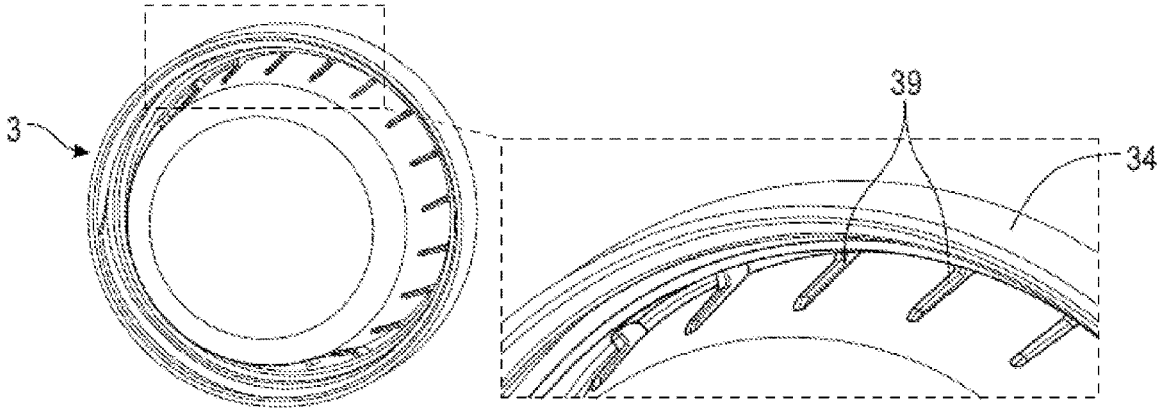
[Fig.5]
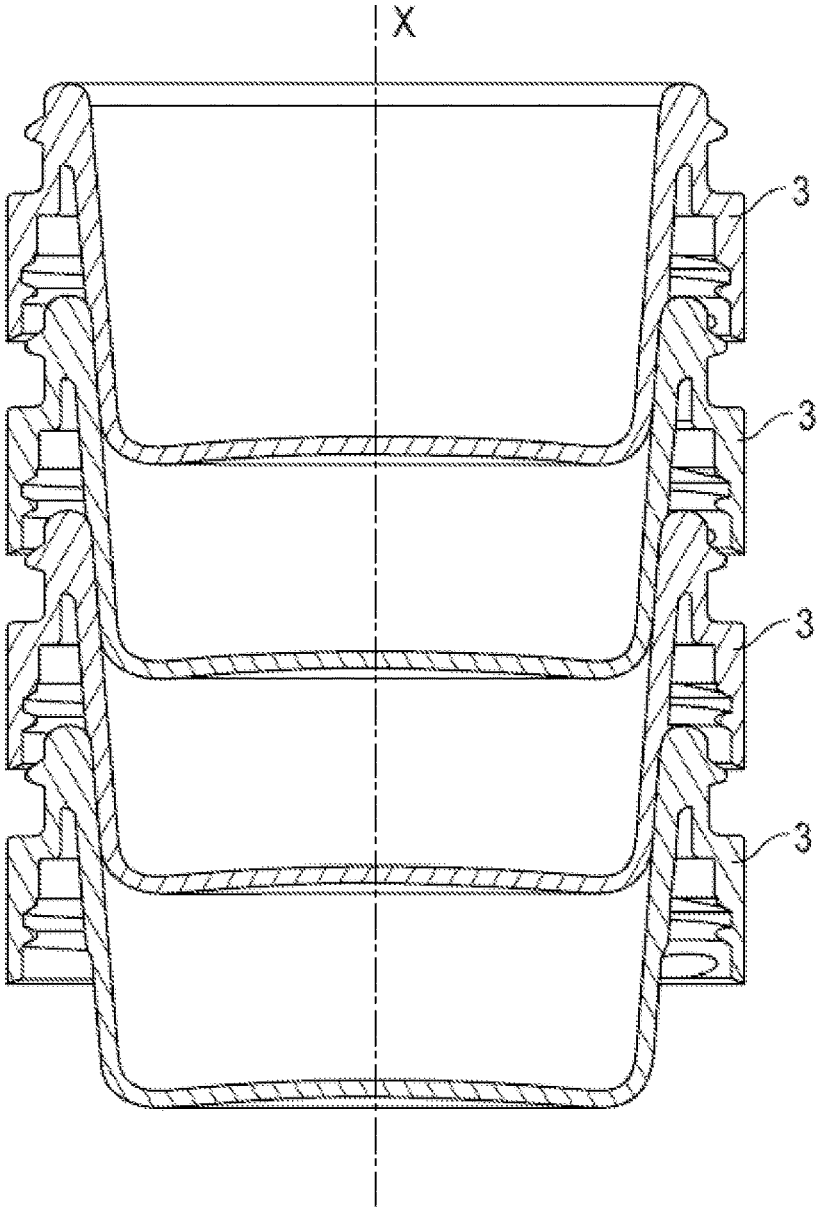

[Fig.6]
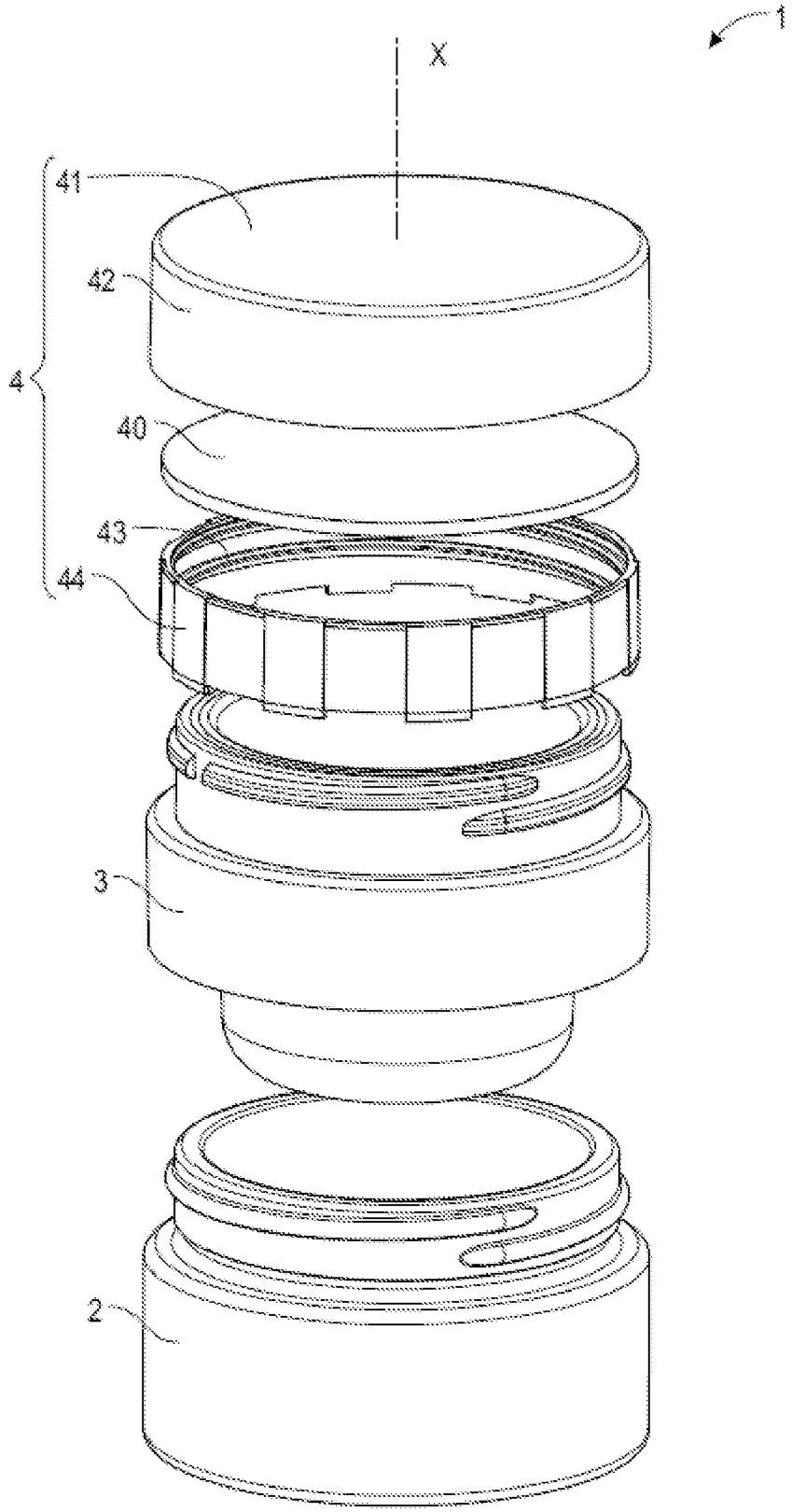

COSMETIC PRODUCT DISPENSER POT WITH A STACKED BASE, REFILL AND COVER

CROSS REFERENCE TO RELATED APPLICATIONS

This application claims priority under 35 U.S.C. § 119(a) to French patent application number 2110079, filed on Sep. 24, 2021, the entire teachings of which are incorporated herein by reference.

BACKGROUND OF THE INVENTION

Field of the Invention

The invention relates to the field of the cosmetic product dispenser pots, such as skincare cream or make-up powder

Description of the Related Art

A classic pot consists of a base that directly receives the cosmetic product, and a cover that closes the pot. Thus the product is in direct contact with the inner walls of the base. When the base is empty, the user throws away the entire pot. Hence the idea of integrating a cosmetic product refill in the pot, to avoid throwing it away, and reuse it, especially since the base and the cover also have an aesthetic function, and are thus designed in noble materials, such as glass.

A cosmetic product dispenser pot is known, including a base receiving a cup in which a cosmetic product is contained. These pots are closed with a cover.

The base is adapted to receive the cup. The base and the cup have corresponding shapes. The pot includes means for holding the cup within the base. The base does not directly accommodate cosmetic products. It is only used to receive the cup. The cup is completely hidden inside the base.

The cup is removable, so that it can be replaced when empty. Thus the pot is refillable with product.

The disadvantage of this type of pot is the complexity of the shapes between the base and the cup, so that they are compatible. Indeed, it is usual to provide flexible legs, swivel platforms, clamping lugs, etc., which complicate the manufacture of the pieces forming the pot. Thus, the pieces forming the pot are designed in plastic in order to integrate all these functionalities. They cannot be designed in more noble materials, such as glass. Moreover, with this type of pot, the base cannot receive the product directly, without a cup, because the product would be housed for example under the legs, and would stagnate in non-accessible areas. In addition, it would not be pleasant for the user to run his finger over flexible legs or lugs on the bottom of the pot.

In a conventional pot, where the base directly accommodates the cosmetic product, there can be no functionality in the inner walls of the base. These walls must be smooth and without protruding angles.

Also, since there can be no functionality in the inner walls of a conventional base, the integration of a cup is not possible.

BRIEF SUMMARY OF THE INVENTION

The purpose of the present invention is to overcome the various disadvantages set out above, by means of a pot for dispensing cosmetic product including a conventional base which can receive the cosmetic product directly, and receive a refill when it is empty, in order to reuse the complete pot, including the cover of the pot.

The cosmetic product dispenser pot according to the invention includes, in a conventional manner:

- a base having a hollow body surmounted by a neck, the base defining a housing adapted to receive the cosmetic product;
- at least one refill of cosmetic product mounted on the base,
- a cover which closes the pot and adapted to be attached to the base or the refill.

The base, the refill and the cover are successively stacked.

The main characteristic of this device is that the refill has a tank for storing the cosmetic product, the inner volume of which is at least identical to the inner volume of the housing of the base, the tank being inserted into the housing of the base by descending below the level of the neck of the base.

The main idea of this invention is to provide a refill that can be mounted on the base, and that can be closed by the cover that initially closes the base, when the latter is filled with product.

The refill must therefore be compatible with the cover and with the base, so that it can be inserted between them.

The tank of the refill descends inside the base, until it gets close to the bottom of the base, or even touching it, in order to use the available space as much as possible, to hide the major part of the tank, and to obtain a pot the most compact as possible.

The refill must contain at least the same volume of product as originally offered in the base. Thus, after inserting the refill, the user finds himself with a full pot as when he first purchased it.

According to the various embodiments of the invention, which may be taken together or separately:

- the refill has a ring on which the cover can be mounted.
- the ring has an upper part for attaching to the cover, and a lower part for attaching to the base.
- the upper part of the ring is identical to the neck of the ring.
- the cover has an upper closing wall and a peripheral wall for attaching to the base or to the refill, the lower part of the ring being identical to the peripheral wall of the cover.
- the tank has a bottom located in the vicinity of a bottom of the base.
- the tank is connected to the ring by an upper peripheral edge.
- the tank is connected to the ring by means of legs extending between an external surface of the tank and an internal surface of the ring.
- the refill consists of a single piece.
- the refill consists of two pieces, i.e. a tank and a ring, which are integral to each other.
- the tank consists of a flexible bag.
- the pot includes attachment means:
  - between the cover and the base or the refill,
  - between the refill and the base;
- the attachment means consist of corresponding threads for a screw mounting.
- the refill includes anti-rotation means limiting the rotation of the refill in the base when opening and closing the cover.

the anti-rotation means consist of a plurality of ribs regularly arranged on the external surface of the tank, and located opposite the neck of the base once the refill is mounted in the base.

the cover includes sealing means.

the sealing means consist of a seal.

the seal is in PP.

all the pieces making up the pot are made of a single material.

the only material used to manufacture the complete pot is preferably PP.

The invention also relates to a cosmetic product refill for a pot for dispensing cosmetic product, including a tank for storing the cosmetic product and a ring for mounting in the pot, the tank having an inner volume that is at least identical to the inner volume of a base of the pot, the ring having an upper part adapted to be attached to a cover of the pot, and a lower part adapted to be attached to the base of the pot.

The invention finally relates to a set of refills as described above, these refills being stacked in such a way that the tank of an upper refill penetrates the tank of a lower refill Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is an exploded and perspective view of the pot according to the invention, with a refill;

FIG. 2 is a cross-sectional view of the assembled pot, without refill, according to the invention;

FIG. 3 is a cross-sectional view of the assembled pot, with a refill;

FIG. 4 is a bottom view of the refill, with a detail view on the ribs of the refill;

FIG. 5 shows several stacked refills;

FIG. 6 shows an exploded and perspective view of the pot with an alternative cover.

DETAILED DESCRIPTION OF THE INVENTION

By convention, the "axial" direction corresponds to the main extension of the receptacle, illustrated by the axis X in FIG. 1, and the "radial" direction is orthogonal to the axial direction.

In the following detailed description of the figures, the terms "upper" and "lower" or "top" and "bottom" will be used without limitation in reference to the axial direction. Thus, the term "upper" refers to a part located in the vicinity of a cover of the pot, and the term "lower" refers to a part located in the vicinity of a bottom of the pot.

Similarly, the terms "outer or external" and "inner or internal" are used with reference to the radial direction, an outer element being radially further from the axis X than an inner element.

The cosmetic product dispenser pot 1 shown in FIG. 1 in exploded view, extends along a main axis X, and consists mainly of a base 2, a refill 3 and a cover 4.

Each piece has a circular cross section.

The pot 1 is cylindrical.

FIG. 2 shows the base 2 which can be closed by the cover 4, for example by screwing it on.

This FIG. 2 shows the pot 1 which is initially purchased by the user.

The base 2 is hollow and has a body 25 surmounted by a neck 22.

The base 2 defines an inner housing 24 storing cosmetic product 38.

The product 38 is thus directly in contact with the inner walls of the base 2, in particular the inner walls of the body 25, and the inner wall of the neck 22, as the product 38 may also be contained within at least one part of the neck 22.

The housing 24 of the base 2 defines a predefined inner volume for receiving a predefined amount of cosmetic product 38.

The cover 4 is mounted on the neck 22 of the base 2.

Preferably, the neck 22 and the cover 4 include attachment means, in this case corresponding internal and external threads, allowing the cover 4 to be screwed onto the neck 22 of the base 2.

The cover 4 has an upper closing wall 41 and a peripheral wall 42 for attachment to the base 2. The thread 43 is provided in the inner surface of this peripheral wall 42 of the cover 4.

The outer surface of this peripheral wall 42 of the cover 4 is located in line with the outer surface of the body 25 of the base 2.

The outer diameter of the body 25 of the base 2 is identical to the outer diameter of the cover 4. Thus, there is a continuity in the external shell of the pot 1. This gives the pot 1 a certain aesthetic appearance.

There are no roughness or protruding corners in the inner walls of the base 2. These walls are smooth to the touch, so that the user can pick up the product 38 easily, anywhere in the housing 24.

When the base 2 is empty, the user has the option of adding a refill 3 to the pot 1, as shown in FIGS. 1 and 3.

This refill 3 filled with cosmetic product 38 is inserted between the base 2 and the cover 4.

The refill 3 is integrated into the pot 1 in such a way as to be as discreet as possible. It is partially hidden inside the base 2. In fact, the refill 3 has a tank 31 for storing the cosmetic product 38 which penetrates inside the housing 24 of the base 2. This tank 31 is sized to occupy at most the volume of the housing 24 of the base 2. Thus, the pot 1 including the refill 3 remains compact.

In the present case, the tank 31 descends below the neck 22 of the base 2, and approaches the bottom 21 of the base 2. The bottom 30 of the tank 31 may rest on the bottom 21 of the base 2, or remain at a distance, depending on the size of the tank 31 and depending on the material used to manufacture the tank 31.

For example, the tank 31 may be rigid, and trapezoidal in cross-section, as shown in the figures. When mounted on the base 2, it remains slightly away from the bottom 21 of the base 2.

For example, the tank 31 may be flexible, such as a flexible bag, and then come into contact with the walls of the housing 24 of the base 2 (not shown).

More than half the height of the tank 31 is inserted into the base 2.

The tank 31 has a storage volume of the product 38 that is at least the identical to the storage volume of the product 38 provided by the housing 24 of the base 2. The idea is that the user can refill his pot 1 with the same amount of product 38 as when he initially purchased the pot 1, without refill 3.

Thus the user ends up with a refilled pot 1, while having kept the base 2 and the cover 4.

In order to keep the base 2 and the cover 4, the refill 3 must be compatible with the base 2 on the one hand, and with the cover 4 on the other.

For this purpose, the refill 3 includes an annular ring 34, to which the tank 31 is attached, and which allows to make the link between the base 2 and the cover 4.

In particular, the ring 34 has an upper part 33 used for the connection with the cover 4, and a lower part 32 used for the connection with the base 2.

The external surface of the upper part 33 has a thread 36 which cooperates with the thread 43 of the cover 4, to allow the cover 4 to be attached to the refill 3 by screwing.

This external surface of the upper part 33 is identical to the external surface of the neck 22 of the base 2. These two surfaces have identical functions.

The internal surface of the lower part 32 has a thread 35 which cooperates with the thread 23 of the base 2, to allow the refill 3 to be attached to the base 2 by screwing.

This internal surface of the lower part 32 is identical to the internal surface of the peripheral wall 42 of the cover 4. These two surfaces have identical functions.

Thus, the refill 3 adapts to the initial pot 1, and can easily be inserted between the base 2 and the cover 4.

The ring 34 has a shoulder between its lower part 32 and its upper part 33, in order to respect the diameters. In the present case, the external diameter of the lower part 32 corresponds to the external diameter of the cover 4, and the external diameter of the upper part 33 corresponds to the external diameter of the neck 22 of the base 2.

Thus, when the general outer shell of the pot 1 is viewed, the lower part 32, which is the only part of the refill 3 visible to the user, is flush with the body 25 of the base 2 and flush with the peripheral wall 42 of the cover 4. The three pieces are aligned, and have the same outer diameters.

The shoulder is located just above the free end of the neck 22 of the reservoir, in order to maximize the compactness of the pot 1 when all pieces are screwed together.

In the example shown, the ring 34 is attached to the tank 31 at the level of an upper peripheral edge 37.

Other types of attachments may be contemplated within the scope of the present invention. For example, the ring 34 may be attached to the tank 31 by means of a plurality of legs, connecting the ring 34 at the level of its shoulder, or at the level of its upper part 33, to the outer surface of the tank 31.

The refill 3 can be manufactured in one piece.

The refill 3 may also be manufactured in several pieces, for example a separate ring 34 and a separate tank 31, which are then assembled to form the refill 3.

The refill 3 can be manufactured by molding, regardless of the number of pieces.

The trapezoidal shape of the tank 31 is convenient for the removal of the refill 3.

FIG. 4 shows more precisely the external shape of the refill 3.

The (un)screwing of the cover 4 with respect to the refill 3 is performed in the same direction as the (un)screwing of the refill 3 with respect to the base 2.

The refill 3 is provided with anti-rotation means so that it does not rotate in the base 2 when the user turns the cover 4. This would cause the refill 3 to unscrew in the long term, which is not desirable. To avoid this, ribs 39 are provided on the outer surface of the tank 31.

These ribs 39 are evenly distributed around the perimeter.

They extend along the wall of the tank, parallel to the axis X, preferably.

They extend along the length of the opposite ring 34. More precisely, they start under the edge 37 connecting the tank 31 to the ring 34, and end opposite the thread of the lower part 32 of the ring 34.

These ribs 39 come into contact with the inner wall of the neck 22 of the base 2.

When the user unscrews the cover 4, the ribs 39 block the rotation of the refill 3 in the base 2, by rubbing/pressing against the neck 22.

These ribs 39 could extend over the entire height of the tank 31.

These ribs 39 could extend only over the area opposite the neck 22 of the base 2.

The refills 3 can easily be stacked on top of each other, as shown in FIG. 5, for ease of transport. In this case, the refills are empty to allow an optimal stacking. The tank of an upper refill penetrates into the tank of a lower refill, and this all along the stacking.

It is possible to stack 2, 3 or 4 refills, or more.

In the case where the refill 3 is rigid, the user can leave the base 2 in his bathroom and take with him only the refill 3 with the cover 4, in a nomadic way.

When the refill 3 is purchased, the latter is closed with a waterproof lid, for example.

Preferably, the base 2 is made of glass, terracotta, concrete, wood, or metal to ensure an aesthetic effect, and the refill 3 is made of aluminum or a plastic material.

The plastic material may be selected from polypropylene (PP), recycled polypropylene (R-PP), polyethylene terephthalate (PET), recycled polyethylene terephthalate (R-PET), thermoplastic elastomer (TPE), polyethylene (PE), such as the low density polyethylene (LDPE) and/or the high density polyethylene (HDPE), composite material, post-consumer recycled material (PCR and/or similar material). Preferably, it is polypropylene and/or polyethylene terephthalate, whether recycled or not.

Thus, advantageously, all the pieces, namely the base 2, the refill 3 and the cover 4 are made of plastic material chosen from polypropylene (PP) and/or polyethylene terephthalate (PET).

In addition, the use of plastics, in particular similar plastics for the entire pot 1, allow to facilitate the recycling. In particular, the polypropylene and the polyethylene terephthalate are two plastic materials whose recycling cycle is well known.

The pot 1 can be made in 3D printing.

In particular, the base 2, the refill 3 and the cover 4 can be made by 3D printing. Such a printing method allows in particular to freely produce these pieces with patterns and shapes that contribute to the aesthetic appearance of the pot 1.

As shown in FIG. 6, the cover 4 can be more elaborate.

In the present case, it may be provided with sealing means, in this case a seal 40 in the form of PP disc. This choice of material is important because it must be compatible with the material used for the other pieces of the pot. In this case, all pieces are made of the same PP material. This allows to have a single recycling stream.

This seal is placed against the upper wall 41 of the cover, and then a ring 44 is inserted and snapped into the cover 4. This ring 44 is in contact against the peripheral wall 42.

Thus the seal 40 is tightly clamped between the upper wall 41 and the upper edge of the ring 44. The seal 40 is non-removable and easily cleaned.

The internal thread 43 of the cover 4 is this time carried by the inner surface of the ring 44, and no longer by the inner surface of the peripheral wall 42.

The operation of the cover 4 in relation to the refill 3 and in relation to the base 2 remains unchanged.

The embodiments shown in the cited figures are only possible examples, in no way limiting, of the invention which, on the contrary, encompasses the variations of shapes and designs within the reach of the person skilled in the art Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows.

The invention claimed is:

1. A pot for dispensing cosmetic product comprising:

a base having a hollow body surmounted by a neck, said base defining a housing adapted to receive the cosmetic product;

at least one refill of cosmetic product mounted on the base; and a cover which closes the pot and is adapted to be attached to the base or the at least one refill, the base, the at least one refill and the cover being successively stacked, wherein the at least one refill has a tank for storing the cosmetic product, an inner volume of which is at least identical to an inner volume of the housing of the base, said tank being inserted into the housing of the base by descending below a level of the neck of the base, wherein said at least one refill has a ring on which the cover can be mounted, wherein said ring has an upper part for attaching to the cover, and a lower part for attaching to the base, wherein the upper part of the ring of the refill has an annular external surface provided with attachment means, and the neck of the base has an annular external surface provided with attachment means, both attachment means being identical, and a cross section profile of the annular external surface with the attachment means of the upper part of the ring being identical to a cross section profile of the annular external surface with the attachment means of the neck.

2. The pot according to claim 1, wherein the cover has an upper closing wall and a peripheral wall for attaching to the base or to the at least one refill, the shape of said lower part of the ring, below the attachment means with the upper part, being identical to the shape of the peripheral wall of the cover, below the attachment means with the upper closing wall.

3. The pot according to claim 1, wherein the tank has a bottom located in the vicinity of a bottom of the base.

4. The pot according to claim 3, wherein said at least one refill has a ring on which the cover can be mounted, and wherein the tank is connected to the ring by an upper peripheral edge.

5. The pot according to claim 1, wherein the at least one refill consists of a single piece.

6. The pot according to claim 1, wherein the attachment means:

between the cover and the base or the at least one refill; and between the at least one refill and the base, said attachment means consisting of corresponding threads for a screw mounting.

7. The pot according to claim 1, wherein the at least one refill comprises anti-rotation means limiting rotation of the at least one refill in the base when opening and closing the cover.

8. The pot according to claim 1, wherein the cover comprises sealing means.

9. The pot according to claim 8, wherein said sealing means consist of a seal.

10. The pot according to claim 1, wherein all pieces making up the pot are made of a single material.

* * * * *